US009285704B2

(12) United States Patent
Okada

(10) Patent No.: US 9,285,704 B2
(45) Date of Patent: Mar. 15, 2016

(54) IMAGE FORMING APPARATUS OPERABLE IN MODE THAT RESTRICTS TONER SUPPLY

(71) Applicant: CANON KABUSHIKI KAISHA, Tokyo (JP)

(72) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/517,323

(22) Filed: Oct. 17, 2014

(65) Prior Publication Data

US 2015/0117880 A1 Apr. 30, 2015

(30) Foreign Application Priority Data

Oct. 25, 2013 (JP) ..... 2013-221819

(51) Int. Cl.
*G03G 15/08* (2006.01)
*G03G 15/00* (2006.01)

(52) U.S. Cl.
CPC ..... *G03G 15/0831* (2013.01); *G03G 15/0849* (2013.01); *G03G 15/556* (2013.01)

(58) Field of Classification Search
CPC ..... G03G 15/0877; G03G 15/0865; G03G 15/0831; G03G 15/556; G03G 15/0849; G03G 15/0856
See application file for complete search history.

(56) References Cited

U.S. PATENT DOCUMENTS

| | | | |
|---|---|---|---|
| 5,585,899 | A | 12/1996 | Palumbo et al. |
| 6,999,689 | B2 | 2/2006 | Kinoshita et al. |
| 2005/0063714 | A1 | 3/2005 | Kinoshita et al. |
| 2012/0033982 | A1 * | 2/2012 | Kubota et al. ..... 399/27 |

FOREIGN PATENT DOCUMENTS

| | | | |
|---|---|---|---|
| JP | 11-095536 | A | 4/1999 |
| JP | 3576769 | B2 | 10/2004 |
| JP | 2005-062848 | A | 3/2005 |
| JP | 2008-209795 | A | 9/2008 |

OTHER PUBLICATIONS

Search Report in European Patent Application No. 14189997.1, dated Mar. 18, 2015.

* cited by examiner

*Primary Examiner* — G. M. Hyder
(74) *Attorney, Agent, or Firm* — Fitzpatrick, Cella, Harper & Scinto

(57) ABSTRACT

An image forming apparatus, which prohibits an image forming operation based on a detection result of a remaining amount detecting unit, thereafter immediately allows the image forming operation based on a detection result of a replacement detecting unit, performs a supply restriction mode which restricts a toner supply amount such that a toner supply amount in a predetermined initial period after allowing the image forming is smaller than that in a normal mode in a case where a detection result of a toner density detecting unit and a target value are under the same conditions, respectively.

7 Claims, 10 Drawing Sheets

IMAGE FORMING APPARATUS OPERABLE IN MODE THAT RESTRICTS TONER SUPPLY

BACKGROUND OF THE INVENTION

1. Field of the Invention

The present invention relates to an image forming apparatus such as a copy machine and a printer.

2. Description of the Related Art

Conventional image forming apparatuses using a two-component developer include one which uses a toner bottle for replenishing the apparatus with toner in order to maintain charging characteristics of toner. When there becomes no toner in a toner bottle, the toner bottle is replaced with a new toner bottle. As described in Japanese Patent Laid Open No. 2005-62848, absence of toner (no toner) is decided responsively to a value of a toner density sensor which measures TD ratio of the two-component developer stored in the developing container. After a toner bottle is changed, a toner density recovery sequence for recovering toner density is performed. In the toner density recovery sequence, whether the toner bottle is changed with a new bottle or not is decided responsively to a value of the toner density sensor.

A problem of the toner density recovery sequence is that the image forming apparatus cannot be used right after a toner bottle is changed. For a user who exchanges a toner bottle, it could be stressful not to be able to use the image forming apparatus right after exchange of a toner bottle. Therefore, it is desired in view of usability that the image forming apparatus can be used right after exchange of a toner bottle.

However, when image forming is allowed without performing the toner density recovery sequence, toner supply is performed with the TD ratio lowered. Therefore, when the same supply sequence as usual is performed, the TD ratio suddenly increases because supply quantity is large, causing the charging characteristics of toner to change a lot. In this case, in the image forming immediately after the exchange, a density change per a sheet becomes large. Thereby the user is liable to recognize the color change. Further, when the TD ratio rapidly increases, an overshoot may occur, in which the TD ratio exceeds the target value. In order to lower the TD ratio, it is necessary to wait for consumption of toner by image forming and the TD ratio exceeds the target value for a certain time period.

Therefore, Japanese Patent Laid Open No. 2008-209795 discloses the structure in which a target value of toner supply control is lowered as compared with the usual image forming immediately after the image forming is allowed, thereby limiting supply amount. However, in the above configuration, a rapid rise in the TD ratio is suppressed, but it is done by changing the initial TD ratio after exchange, so there is a possibility that the TD ratio deviates significantly from the desired TD ratio.

SUMMARY OF THE INVENTION

Therefore, the present invention provides an image forming apparatus which can suppress rapid change of a density level after exchange of toner bottle without changing a target TD ratio and which can make it possible to promptly form an image after exchange of a toner bottle.

The present invention provides an image forming apparatus, comprising:

a developing device which develops an electrostatic latent image formed on an image bearing member using toner and magnetic carrier;

a toner supplying device which supplies toner from a toner bottle storing toner for supply;

a toner density detecting unit which detects information about a toner density inside of the developing device;

a control unit which is able to perform a normal mode which determines a toner supply amount of the toner supplying device based on a detection result of the toner density detecting unit and a predetermined target value;

a remaining amount detecting unit which detects information relating to a remaining amount of the toner bottle; and a replacement detecting unit which detects information for determining whether the toner bottle is to be replaced, wherein the control unit prohibits an image forming operation based on a detection result of the remaining amount detecting unit, thereafter the control unit immediately allows the image forming operation based on a detection result of the replacement detecting unit, and the control unit performs a supply restriction mode which restricts the toner supply amount such that the toner supply amount in a predetermined initial period after allowance of image forming is smaller than the normal mode in a case where a detection result of the toner density detecting unit and the target value are under same conditions, respectively.

Further features of the present invention will become apparent from the following description of exemplary embodiments with reference to the attached drawings.

DESCRIPTION OF THE EMBODIMENTS

First Embodiment

Figure 2:
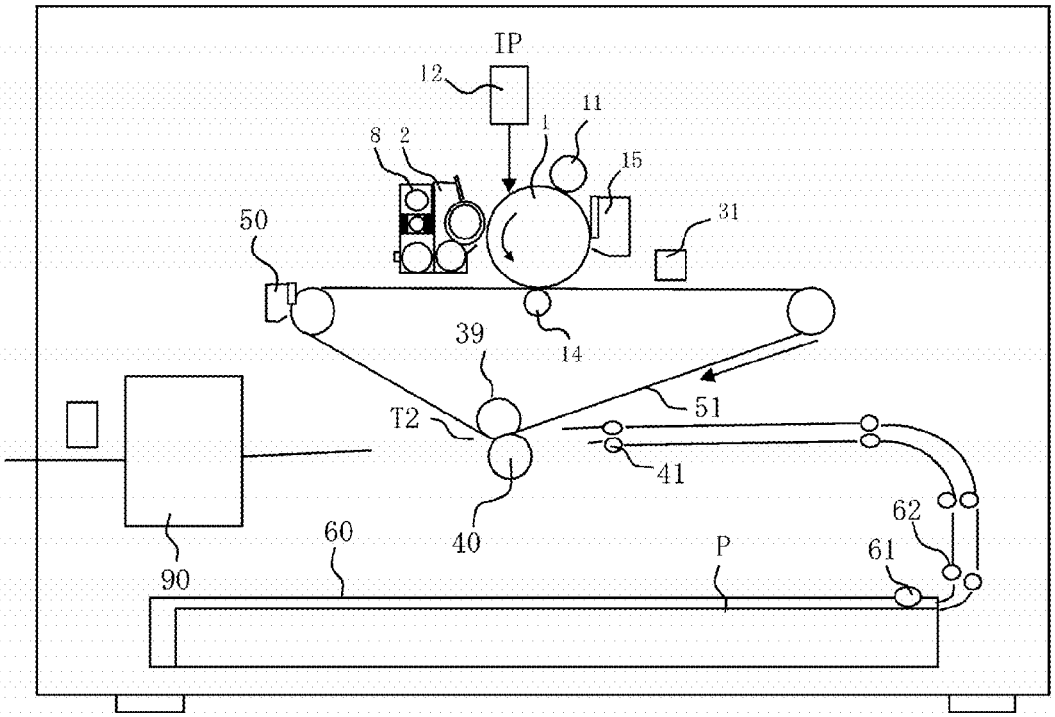
FIG. 2 is a schematic diagram showing a configuration of an image forming apparatus according to the first embodiment.

The first embodiment of the image forming apparatus of the present invention will be described hereunder with reference to the drawings. FIG. 2 is a schematic diagram showing the configuration of the image forming apparatus according to this embodiment.

As shown in FIG. 2, the image forming apparatus of this embodiment includes four image processing units IP according to yellow, magenta, cyan and black, respectively. The four image forming apparatuses are of the same structure. Therefore, in FIG. 2, the other three image processing units IP are omitted.

In each image processing unit IP, a laser beam according to image information is irradiated from the scanner 12 on the photosensitive drum 1 (image bearing member) which is charged by charging roller 11. The electrostatic latent image is developed as a toner image of each color with using toner of each color. The developed toner image of each color is primarily transferred on the intermediate transfer belt 51 so as to overlap the toner images of the other colors by the primary transfer roller 14. Transfer residual toner remaining on the photosensitive drum 1 after the primary transfer is removed by the cleaning device 15.

On the other hand, the sheet P stored in the sheet cassette 60 is conveyed to the secondary transfer portion T2 by the pickup roller 61, the conveying roller 62 and the registration roller 41. The secondary transfer portion T2 is a nip portion where the intermediate transfer belt 51 is nipped by the secondary transfer inner roller 39 and the secondary transfer outer roller 40. The toner image is secondarily transferred to the sheet P at the secondary transfer portion T2. Then, after the toner image is fixed through heat and pressure to the sheet P by the fixing device 90, the sheet P is discharged to the outside of the image forming apparatus. Transfer residual toner remaining on the intermediate transfer belt 51 after the secondary transfer, is removed by the cleaning device 50.

<Image Processing Unit IP>

Figure 1:
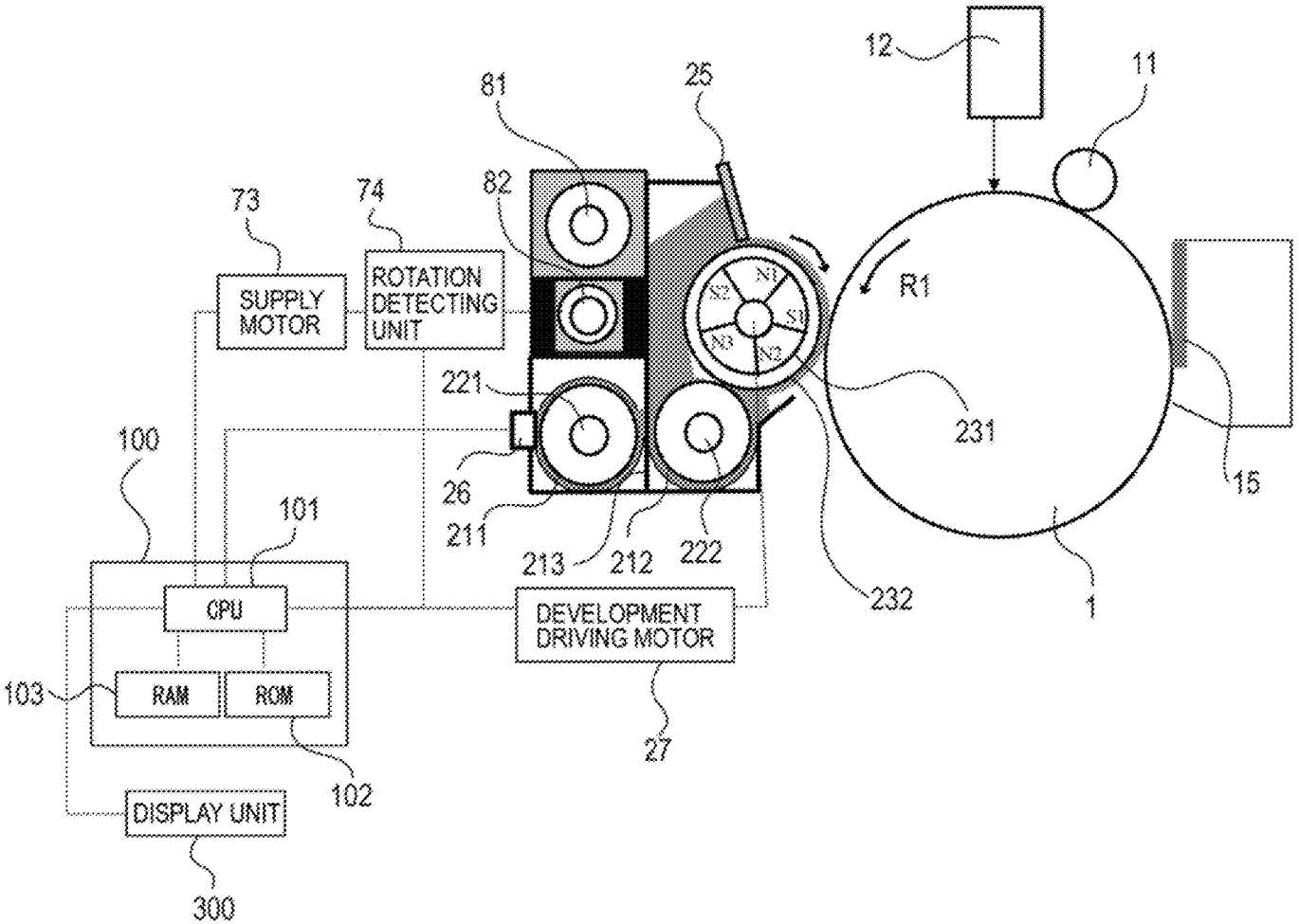
FIG. 1 is a schematic diagram showing a configuration of an image processing unit according to the first embodiment.

FIG. 1 is a schematic diagram showing the configuration of the image processing unit IP. As shown in FIG. 1, the developing device 2 includes the developing chamber 212 and the stirring chamber 211. The developing chamber 212 and the stirring chamber 211 are partitioned by the partition wall 213 extending in the vertical direction. The developing device 2 uses a two-component developer composed of magnetic carrier and non-magnetic toner.

In the developing chamber 212, the developing sleeve 232 of non-magnetic type is provided. In the developing sleeve 232, the magnet 231 of the 5-pole type is fixedly disposed. In the developing chamber 212, the first conveying screw 222 is placed. The first conveying screw 222 stirs and conveys the developer in the developing chamber 212.

In the stirring chamber 211, the second conveying screw 221 is placed. The second conveying screw 221 stirs and conveys the toner for replenishment supplied from the toner bottle 8 and the developer already stored in the developing device 2; thereby the toner density of the developer is made uniform. In the stirring chamber 221, the inductance sensor (toner density detecting means) 26 is provided. The inductance sensor 26 detects a toner density (TD ratio) of the developer.

The developer moves from the stirring chamber 211 to the developing chamber 212 through developer passages (not shown) provided at both ends of the partition wall 213. The developing sleeve 232, the first conveying screw 222 and the second conveying screw 221 are driven by the development driving motor 27.

The developer in the developing device 2 is restrained by magnetic force of the magnetic draw-up pole N3 and conveyed by rotation of the developing sleeve 232. The developer is fully restrained by the magnetic cut pole S2 and the thickness of the developer is regulated by the developer regulating blade 25. The developer is conveyed to a developing region facing the photosensitive drum 1 by rotation of the developing sleeve 232 and the conveying magnetic pole N1. Forming a magnetic brush by the magnetic developing pole S1 in the developing region, only the toner is transferred to the electrostatic latent image on the photosensitive drum 1 by the developing bias applied to the developing sleeve 232, thereby the toner image corresponding to the electrostatic latent image is formed on the photosensitive drum 1.

Figure 3:
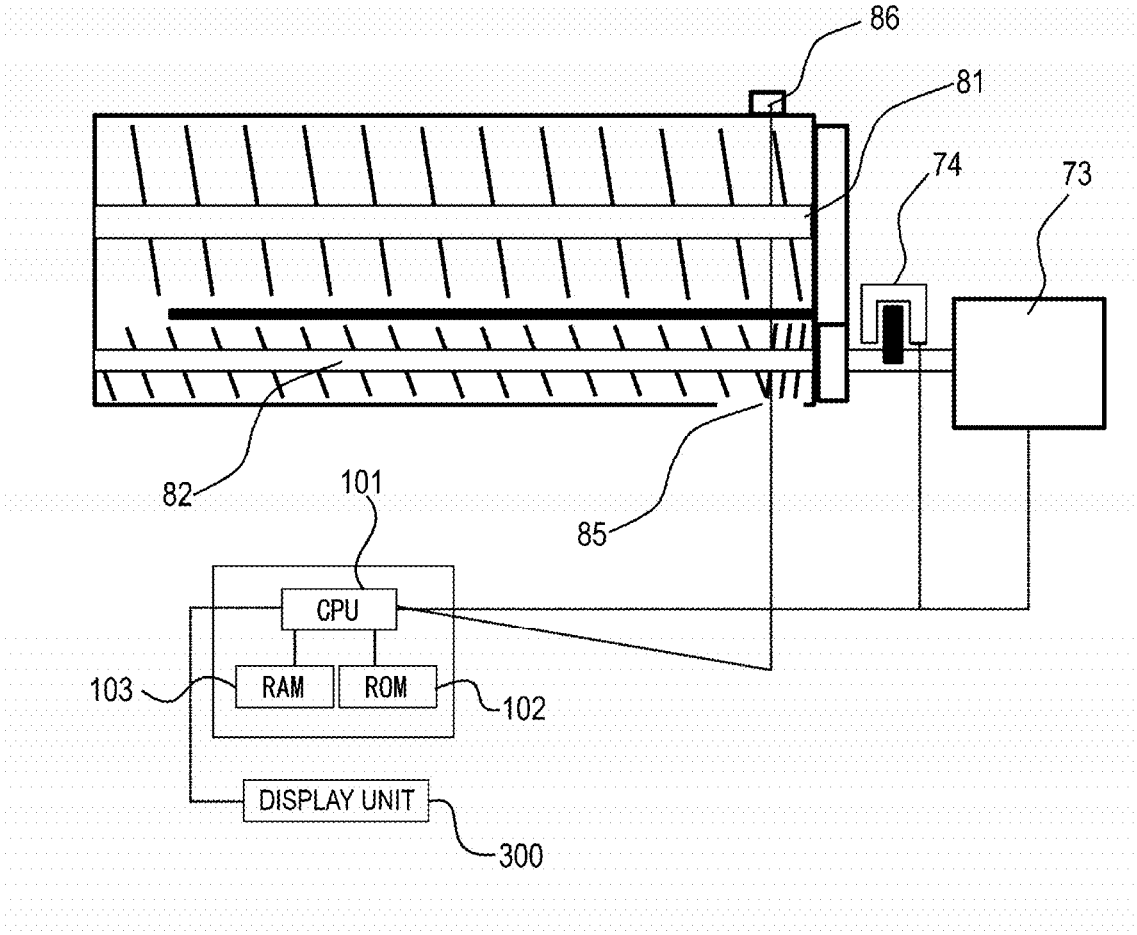
FIG. 3 is a schematic diagram showing a configuration of a toner bottle.

The toner bottle 8 is made to be detachably attachable from the developing device 2. FIG. 3 is a block diagram of the toner bottle 8. As shown in FIGS. 1 and 3, the lower conveying screw 82 supplies the toner stored in the toner bottle 8 to the developing device 2 through supply opening 85. The upper conveying screw 81 conveys the toner stored at the upper portion. The upper conveying screw 81 and the lower conveying screw 82 are rotated by the supply motor 73. The upper conveying screw 81, the lower conveying screw 82 and the supply motor 73 constitute toner supply means.

By the rotation detecting unit 74, rotation of the supply motor 73 is detected in precision of the unit of one rotation of the screw. The CPU 101 of the control unit 100 drives the supply motor 73 such that the supply motor 73 rotates in a predetermined number of rotations. At the upper portion of the toner bottle 8, the toner bottle sensor (exchange detecting means) 86 is disposed, which determines whether the toner bottle 8 is present nor not.

<Toner Supply Control>

A toner density of the developer in the developing device 2 is lowered by the development of the electrostatic latent image. Therefore, control (toner supply control) for supplying toner to the developing device 2 from the toner bottle 8 is performed by the control unit 100. By this control, a toner density of the developer and an image density are controlled to be as constant as possible. Namely, the control unit 100 decides whether the image forming operation is immediately allowed or not based on a detection result of the toner bottle sensor 86 (replacement detecting unit) after prohibiting the image forming operation based on a detection result of the inductance sensor (remaining amount detecting unit) 26. When the image forming operation is allowed, a supply restricting mode is performed, which restricts an amount of the toner supply in the predetermined initial period after allowance more than that in the normal mode.

In the following, the supply amount at the time of the image formation of the Nth sheet in the normal mode will be explained. In this embodiment, the toner supply amount M(N) of the Nth sheet is calculated (decided) from the following equation 3 using the video count supply amount M_Vc(N) calculated from the following Equation 1 and the inductance supply amount M_Indc(N) calculated from the following equation 2. The toner supply control is performed based on the number of rotations B of the supply motor 73 calculated from the following equation 4.

$$M_Vc(N)=Vc\times A_Vc \quad \text{(Equation 1)}$$

Vc: video count value

A_Vc: coefficient

The video count value Vc is calculated from the image information of the Nth output. The video count value Vc changes depending on the image ratio and when the image with 100% image ratio (entire solid black) is outputted, the video count value Vc=1023.

$$M_Indc(N)=(TD_target-TD_Indc(N-1))\times A_Indc \quad \text{(Equation 2)}$$

TD_Indc(N−1): TD ratio which is calculated from a detection result of the inductance sensor 26 in the (N−1)th sheet TD_target: target TD ratio A_Indc: coefficient The coefficient A_Vc and the coefficient A_Indc have been previously recorded in the ROM 102. A_Indc value is set such that M_Indc=300 mg when TD_Indc is lower than TD_target by a value larger than or equal to 1% (TD_target−TD_Indc≤1%). In this embodiment, when recording data into the RAM 103, if the TD ratio is 8.0%, the value of 8.0 is recorded into the RAM 103 and the unit of an amount of toner supply is managed in mg. In addition, the setting A_Indc=300 is recorded in the ROM 102. The reason why A_Indc=300 is recorded is to make the TD ratio stably transition even in an image having a high toner consumption with a high image ratio.

$$M(N)=M_\mathrm{Vc}(N)+M_\mathrm{Indc}(N)+M_\mathrm{remain}(N-1) \quad \text{(Equation 3)}$$

M_remain(N−1) is a residue supply amount which has not been supplied at the previous (N−1)th sheet. The reason why such a residue supply amount occurs is that the toner supply is performed in the unit of one rotation of the screw and supply amount of less than one rotation remains as the residue supply amount. Further, if M<0, then M is set to 0.

$$B=M(N)/T \quad \text{(Equation 4)}$$

The amount T to be supplied to the developing device 2 while the lower toner conveying screw 82 makes one rotation, is stored in the ROM 102 beforehand. The decimals of B are omitted and only the integer part is calculated. The supply motor 73 is rotated by the number of rotations B calculated by Equation 4 at the Nth sheet. In the present embodiment, due to the limitations of the rotational speed of the supply motor 73, the maximum value of B is set to 5 and the remaining supply amount M_remain which has not been supplied, calculated by the following Equation 5 is supplied at the next toner supply.

$$M_\mathrm{remain}=M(N)-B\times T \quad \text{(Equation 5)}$$

In the present embodiment, a configuration for a toner supply control based on the video count information and inductor output is described as an example but the toner supply control method is not limited thereto. For example, the apparatus can be constructed such that a toner density in the developing device 2 is detected based on a density measuring patch provided on the photosensitive drum and that the toner supply control is performed based on the detection result.

(Judgment of Emptiness and Replacement of the Toner Bottle 8)

Absence of toner in the toner bottle 8 (emptiness of the toner bottle 8) is detected by the control unit 100 as explained blow. In this embodiment, when the case where if the TD ratio (TD_Indc) is detected in processing of the Nth sheet is lower than the target TD ratio (TD_target) by a value larger than or equal to 1% is followed by three consecutive sheets, the control unit 100 determines the absence of toner in the toner bottle 8 (emptiness of the toner bottle 8).

If the toner bottle 8 is determined to be empty, the toner bottle replacement instruction "Please replace the toner bottle" is displayed on the display unit 300 and the image forming operation is prohibited. In addition, the remaining supply amount M (remain) is set to 0 and the history of the past is reset. The emptiness judgment of the toner bottle 8 can be performed such that the toner bottle 8 is determined to be empty when the detection result does not change after toner is supplied by driving the supply motor 73 and the development driving motor 27.

In the state where the toner bottle replacement instruction is displayed on the display device 300, it is determined whether or not the toner bottle has been replaced based on a signal of the toner bottle sensor 86. In particular, in the state where the toner bottle replacement instruction is displayed on the display device 300, the absence of the toner bottle 8 is detected when the toner bottle 8 is pulled out once. Thereafter it is determined that the toner bottle 8 has been replaced when the presence of the toner bottle 8 is detected again after the toner bottle 8 is inserted.

It may be determined whether or not the toner bottle 8 has been replaced by having a user press an OK button after "Have you replaced the toner bottle" is further displayed on the display 300 in the state where the toner bottle replacement instruction is displayed. Also, the exchange of the toner bottle 8 may be determined based on a signal value of a circuit board attached to the toner bottle 8, by which whether the toner bottle 8 is new or not is judged. The circuit board may include a resistor which can be burned out when energized. Also, the determination of replacement of the toner bottle 8 is not limited to the above structures and it can be realized by conventional detection methods.

In this embodiment, the emptiness judgment of the toner bottle 8 is performed by using the inductance sensor (remaining amount detecting unit) 26 and by determining based on an inductance output value of the inductance sensor 26. The emptiness judgment is not limited to the above structure and this can also be substituted by variety of known toner remaining amount detecting methods.

(Problems of the Toner Supply Control after Toner Bottle Replacement)

Figure 4:
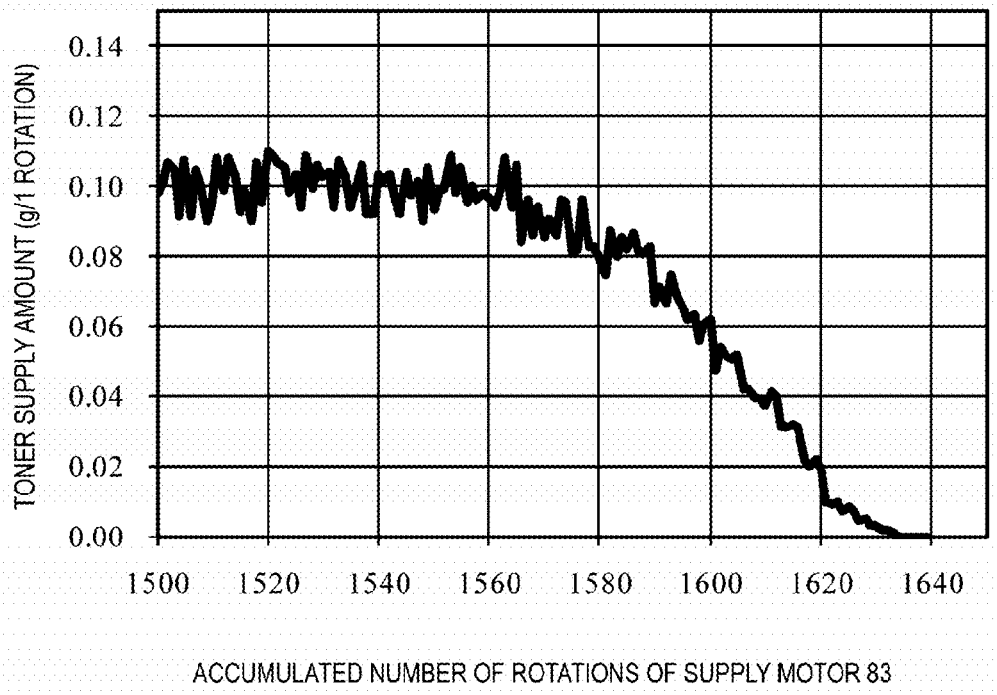
FIG. 4 is a graph showing transition of a toner supply amount immediately before the toner bottle becomes empty.
Figure 5A:
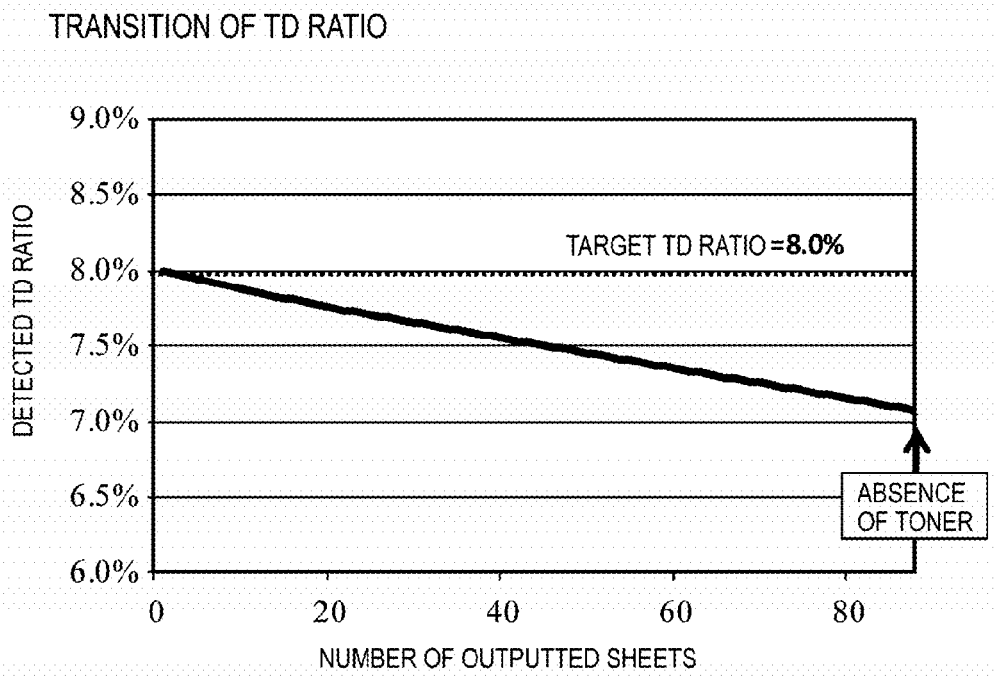
FIG. 5A is a graph showing transition of a TD ratio immediately before the toner bottle becomes empty on the condition of 5% image ratio.
Figure 5B:
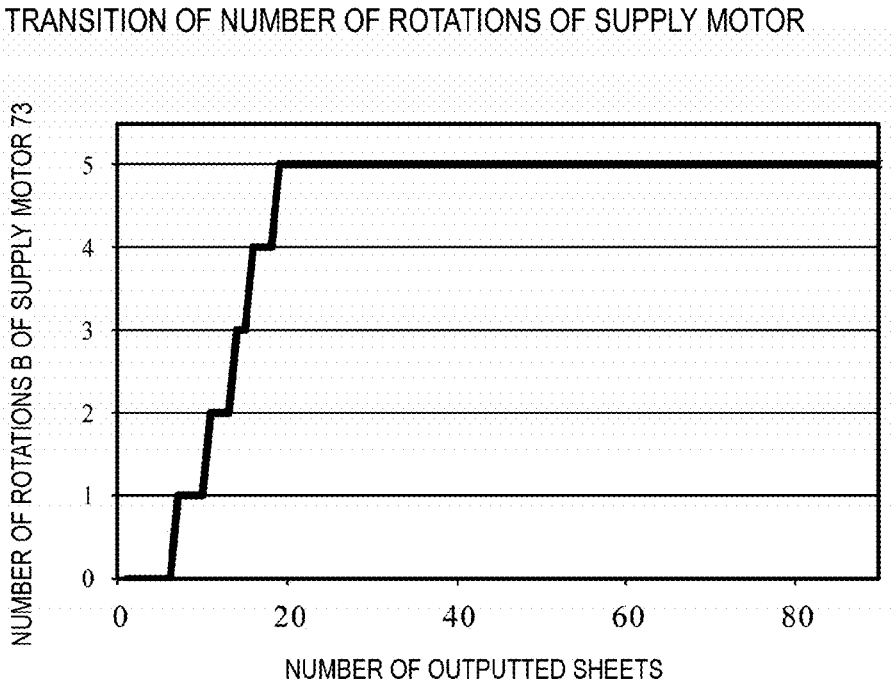
FIG. 5B is a graph showing transition in a number of rotations of a supply motor immediately before the toner bottle becomes empty on the condition of 5% image ratio.

FIG. 4 is a graph showing transition of a toner supply amount immediately before the toner bottle 8 becomes empty. FIG. 5A is a graph showing transition of the TD ratio immediately before the toner bottle 8 becomes empty on the condition of 5% image ratio. FIG. 5B is a graph showing transition in a number of rotations of the supply motor 73 immediately before the toner bottle 8 becomes empty on the condition of 5% image ratio.

As shown in FIGS. 4, 5A and 5B, when a toner supply amount is reduced, a number of rotations of the supply motor 73 is increased as the TD ratio decreases. However, because the TD ratio is not recovered, the TD ratio further decreases, and the toner bottle 8 becomes empty.

Figure 6:
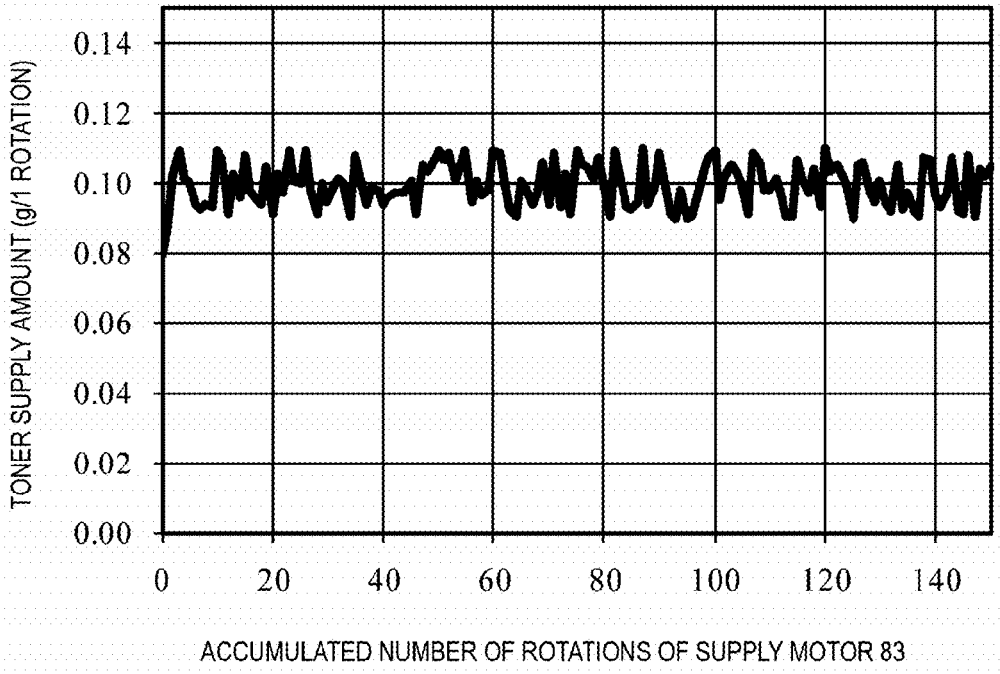
FIG. 6 is a graph showing transition in a toner supply amount of the toner bottle after replacement.
Figure 7A:
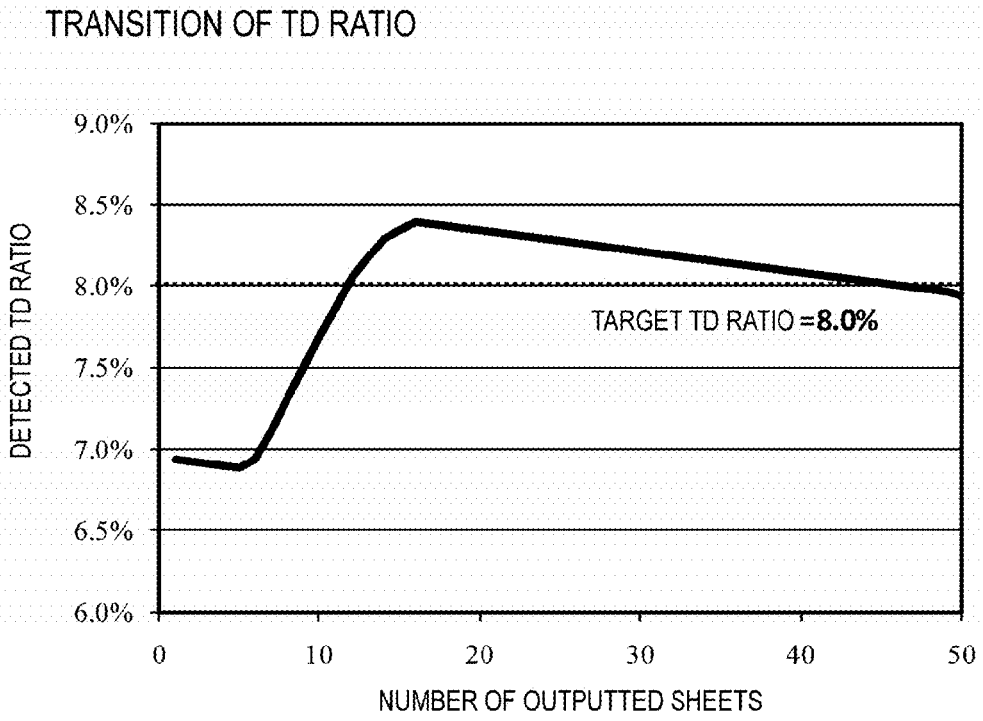
FIG. 7A is a graph showing transition of a TD ratio after the toner bottle is replaced on the condition of 5% image ratio.
Figure 7B:
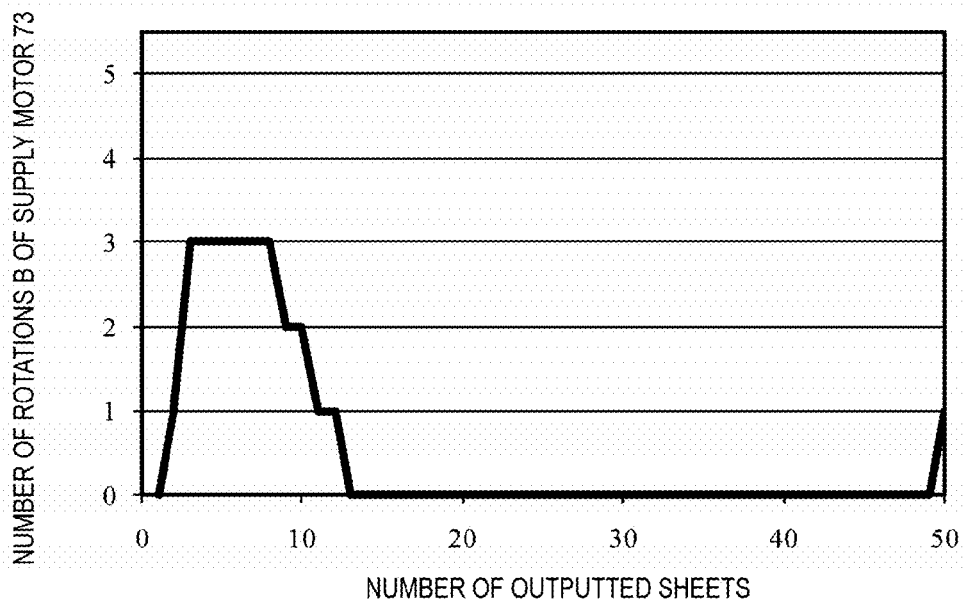
FIG. 7B is a graph showing transition in a number of rotations of the supply motor after the toner bottle is replaced on the condition of 5% image ratio.

FIG. 6 is a graph showing transition of a toner supply amount of the toner bottle 8 after replacement. FIG. 7A is a graph showing transition of the TD ratio after the toner bottle 8 is replaced on the condition of 5% image ratio. FIG. 7B is a graph showing transition in a number of rotations of the supply motor 73 after the toner bottle 8 is replaced on the condition of 5% image ratio.

As shown in FIGS. 6, 7A and 7B, when the toner bottle 8 is empty, the value of remaining supply amount M (remain) is set to 0. For this reason, the number of rotations B of the supply motor 73 for the first sheet after the toner bottle 8 is replaced is 0. However, because the TD ratio is low, the inductance supply amount is large, and the number of rotations B of the supply motor 73 is immediately increased.

The toner supply amount after the toner bottle 8 is replaced returns generally to the values before the toner supply amount is decreased although it fluctuates a little. Therefore, a large amount of toner is supplied to the developing device 2 and the TD ratio detected by the inductance sensor 26 is rapidly increased on and after the fifth sheet where the supply toner reaches the inductance sensor 26, greatly exceeding 8% which is the target TD ratio (target value).

(Toner Supply Control After Replacement of the Toner Bottle According to the Present Embodiment)

A supply limit mode after replacement of the toner bottle according to the present embodiment will be explained. In this embodiment, after it is determined that the toner bottle 8 has been replaced, the toner bottle initial period is provided. In the toner bottle initial period, the coefficient (A_Indc_init) for calculating the inductance supply amount M_Indc which is less than the normal coefficient (A_Indc) is used. In this embodiment, the coefficient A_Indc_init of the toner bottle initial period=100 mg. The inductance supply amount M_Indc(N) in the toner bottle initial period is calculated by the Equation 6 below in place of the Equation 2.

$$M_\mathrm{Indc}(N)=(TD_\mathrm{target}-TD_\mathrm{Indc}(N-1))\times A_\mathrm{Indc_init} \quad \text{(Equation 6)}$$

The release timing of the toner bottle initial period is when the difference value between the detection result (TD ratio) of the inductance sensor 26 and the target TD ratio becomes within a predetermined range. In this embodiment, the release timing of the toner bottle initial period is when the TD ratio (TD_Indc) detected at the Nth sheet gets to satisfy the expression TD_target−TD_Indc(N)≤0.1(%). At this timing, the coefficient A_Indc_init is returned to the coefficient A_Indc.

Incidentally, the present invention is not limited to 0.1(%) in the above expression and it may be other values in consideration of the TD ratio transition. Further, the release timing of the toner bottle initial period may be when the predetermined time lapses or when image forming is performed for the predetermined number of sheets. Furthermore, the release timing of the toner bottle initial period may be when the predetermined amount of toner is supplied and the toner bottle initial period may be released when the accumulated number of rotations of the supply motor 73 exceeds a predetermined value after it is determined that the toner bottle 8 has been replaced. Alternatively, the toner bottle initial period may be released after the toner density recovery sequence for recovering the TD ratio is performed when the TD ratio is less than the target TD ratio by a value larger than or equal to a predetermined value after a predetermined period lapses after it is determined that the toner bottle 8 has been replaced.

Figure 8:
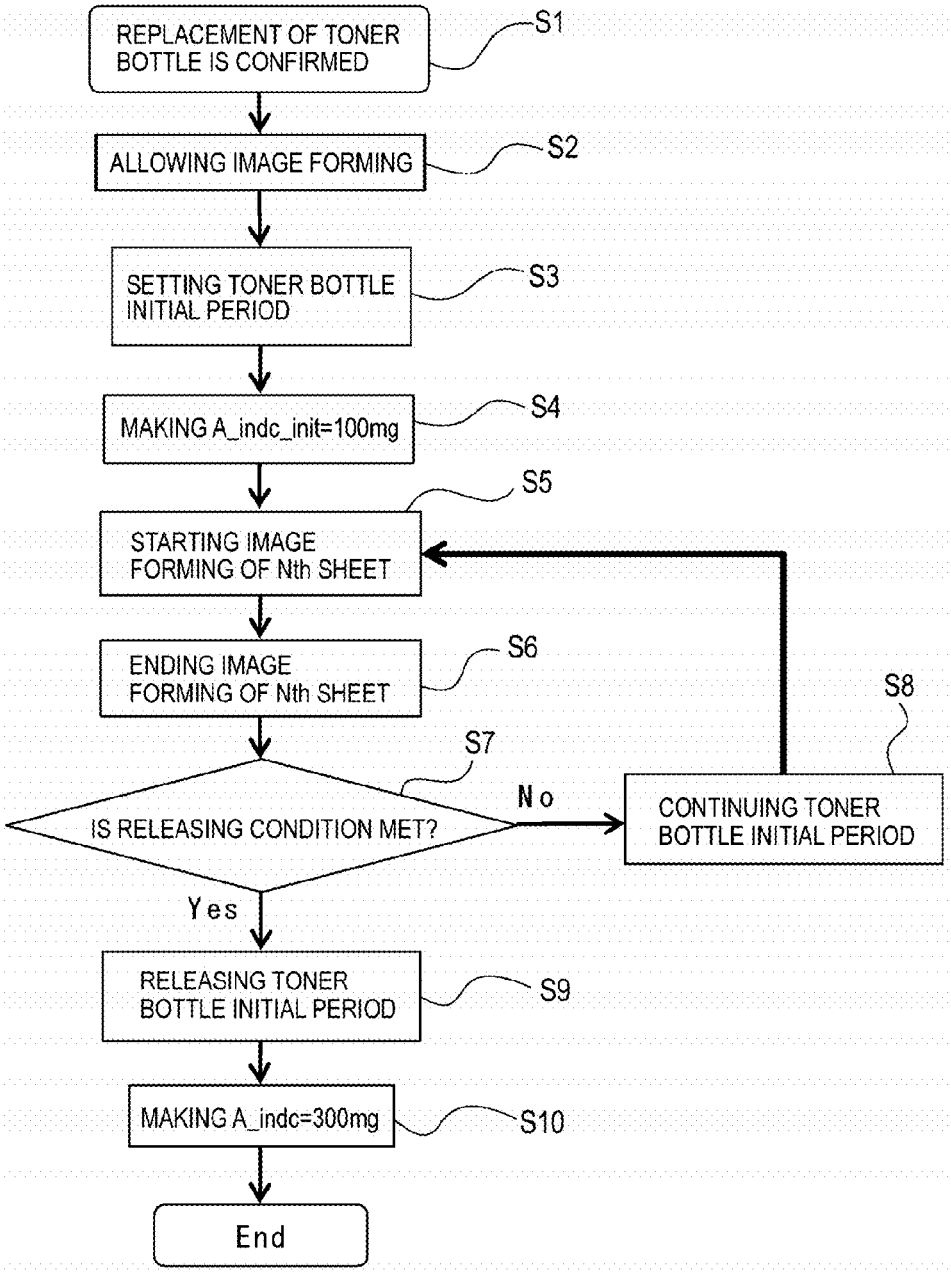
FIG. 8 is a flowchart showing a toner supply control in the first embodiment.

FIG. 8 is a flowchart showing the toner supply control in the present embodiment. As shown in FIG. 8, when it is determined that the toner bottle 8 has been replaced (S1), the image forming is allowed (S2). At this time, the toner bottle initial period is set (S3) and the coefficient, which is used for calculating the inductor supply amount M_Indc, is changed from the A_Indc to A_Indc_init (S4).

The image formation for the Nth sheet is started and after the completion of the image formation for the Nth sheet, whether the toner bottle initial period is released or not is determined (S7). When it is determined not to release the toner bottle initial period in S7, the setting of the toner bottle initial period is continued (S8) and the sequence returns to S5. When it is determined to release the toner bottle initial period in S7, the toner bottle initial period is released (S9) and the coefficient to be used for calculating the inductance supply amount M_Indc is changed from A_Indc to A_Indc_init (S10). Then, the toner supply control after the toner bottle has been exchanged is finished and the sequence returns to the normal toner supply control.

(Effect)

Figure 9A:
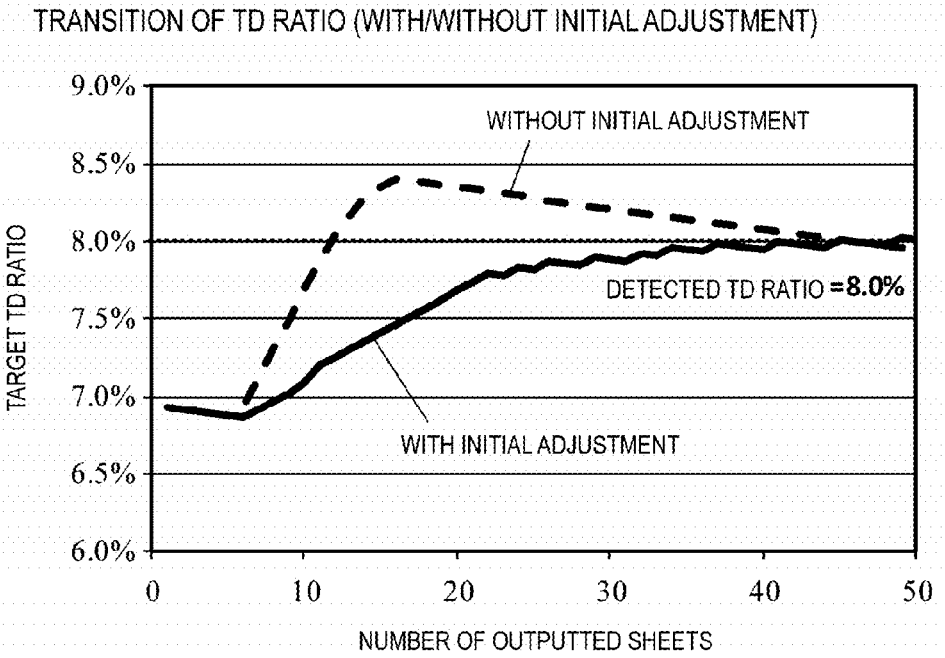
FIG. 9A is a graph showing transition of the TD ratio after replacement of the toner bottle on the condition of 5% image ratio according to the first embodiment.
Figure 9B:
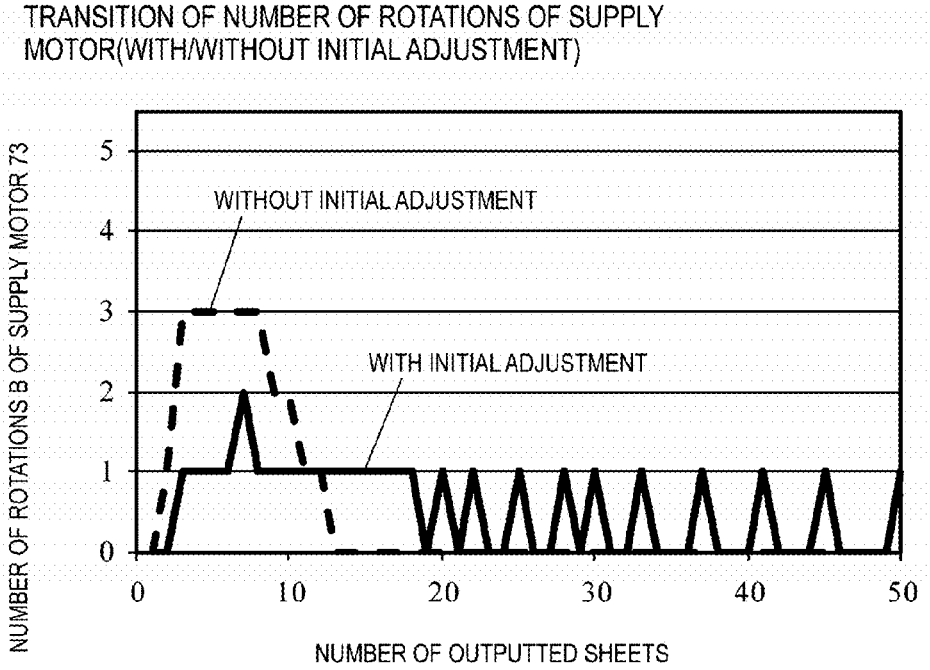
FIG. 9B is a graph showing transition in a number of rotations of the supply motor after replacement of the toner bottle on the condition of 5% image ratio according to the first embodiment.

FIG. 9A is a graph showing transition of the TD ratio after replacement of the toner bottle on the condition of 5% image ratio according to the first embodiment. FIG. 9B is a graph showing transition in a number of rotations of the supply motor 73 after replacement of the toner bottle on the condition of 5% image ratio according to the first embodiment. In FIGS. 9A and 9B, the broken line represents the toner supply control without compensation (adjustment) by the toner bottle initial period and the solid line represents the toner supply control with compensation by the toner bottle initial period of the present embodiment.

As shown in FIGS. 9A and 9B, in this embodiment, by reducing inductance supply amount in the toner bottle initial period after replacement of the toner bottle, the toner supply amount becomes lower than the normal toner supply amount. Thereby, the transition of the toner supply count (a number of rotations B of the supply motor 73) becomes gentle and an increase in TD ratio also becomes gentle. Further, as shown by the broken line, the TD ratio does not greatly exceed the target TD ratio. Therefore, according to the present embodiment, transition of the TD ratio after replacement of the toner bottle becomes gentle and the level of density fluctuation can be reduced.

Second Embodiment

Next, the second embodiment of an image forming apparatus according to the present invention will be explained with reference to the drawings. The same reference numerals are used for the portions in which the same explanation is made as the first embodiment and redundant explanations are omitted.

In the first embodiment, as the coefficient for use in calculating the inductance supply amount M_Indc in the toner bottle initial period, one kind of coefficient is used. In this embodiment, two kinds of coefficients are provided, which are used to calculate the inductance supply amount M_Indc in the toner bottle initial period and one of the two kinds of the coefficient is selected according to the magnitude relation of TD_target and TD_Indc(N−1).

If TD_target≥TD_Indc of (N−1), that is if the TD ratio is smaller than the target value, A_Indc and A_Indc_init are used. On the other hand, if TD_target<TD_Indc of (N−1), that is, if TD ratio is larger than the target value, IC_Indc and C_Indc_init are used. In the present embodiment, A_Indc=C_Indc=C_Indc_init=300 mg and A_Indc_init=100 mg. That is, when TD_target÷TD_Indc(N−1), the expressions 2A and 6A below are used in place of the expressions 2 and 6 and when TD_target<TD_Indc(N−1), the expressions 2C and 6C below are used in place of the expressions 2 and 6.

$$M_\mathrm{Indc}(N)=(TD_\mathrm{target}-TD_\mathrm{Indc}(N-1))\times A_\mathrm{Indc} \quad \text{(Equation 2A)}$$

$$M_\mathrm{Indc}(N)=(TD_\mathrm{target}-TD_\mathrm{Indc}(N-1))\times A_\mathrm{Indc_init} \quad \text{(Equation 6A)}$$

$$M_\mathrm{Indc}(N)=(TD_\mathrm{target}-TD_\mathrm{Indc}(N-1))\times C_\mathrm{Indc} \quad \text{(Equation 2C)}$$

$$M_\mathrm{Indc}(N)=(TD_\mathrm{target}-TD_\mathrm{Indc}(N-1))\times C_\mathrm{Indc_init} \quad \text{(Equation 6C)}$$

As described above, the two kinds of coefficients are used and A_Indc_init is made smaller than the other coefficient. Thereby, as in the first embodiment, transition of the TD ratio after replacement of the toner bottle becomes gentle when the TD ratio is made lower than the target value and the level of density fluctuation is suppressed. On the other hand, in the configuration of the first embodiment, normally the TD ratio does not exceed the target value (TD_target<TD_Indc(N−1)); however, TD ratio exceeds the target value depending on the conditions. In this case, by using the C_Indc_init (=300 mg), it is possible to suppress the toner supply from the toner bottle 8 and to wait for the TD ratio to decrease to the target value as the toner is consumed by the image formation.

The values A_Indc, A_Indc_init, C_Indc and C_Indc_init are not limited to the above values. Other values can be used as long as transition of the TD ratio becomes gentle when the TD ratio is smaller than the target value and the toner supply from the toner bottle 8 is suppressed when the TD ratio is larger than the target value. As for changing the value of C_Indc_init while observing the stability of the TD ratio, it is not limited.

Figure 10:
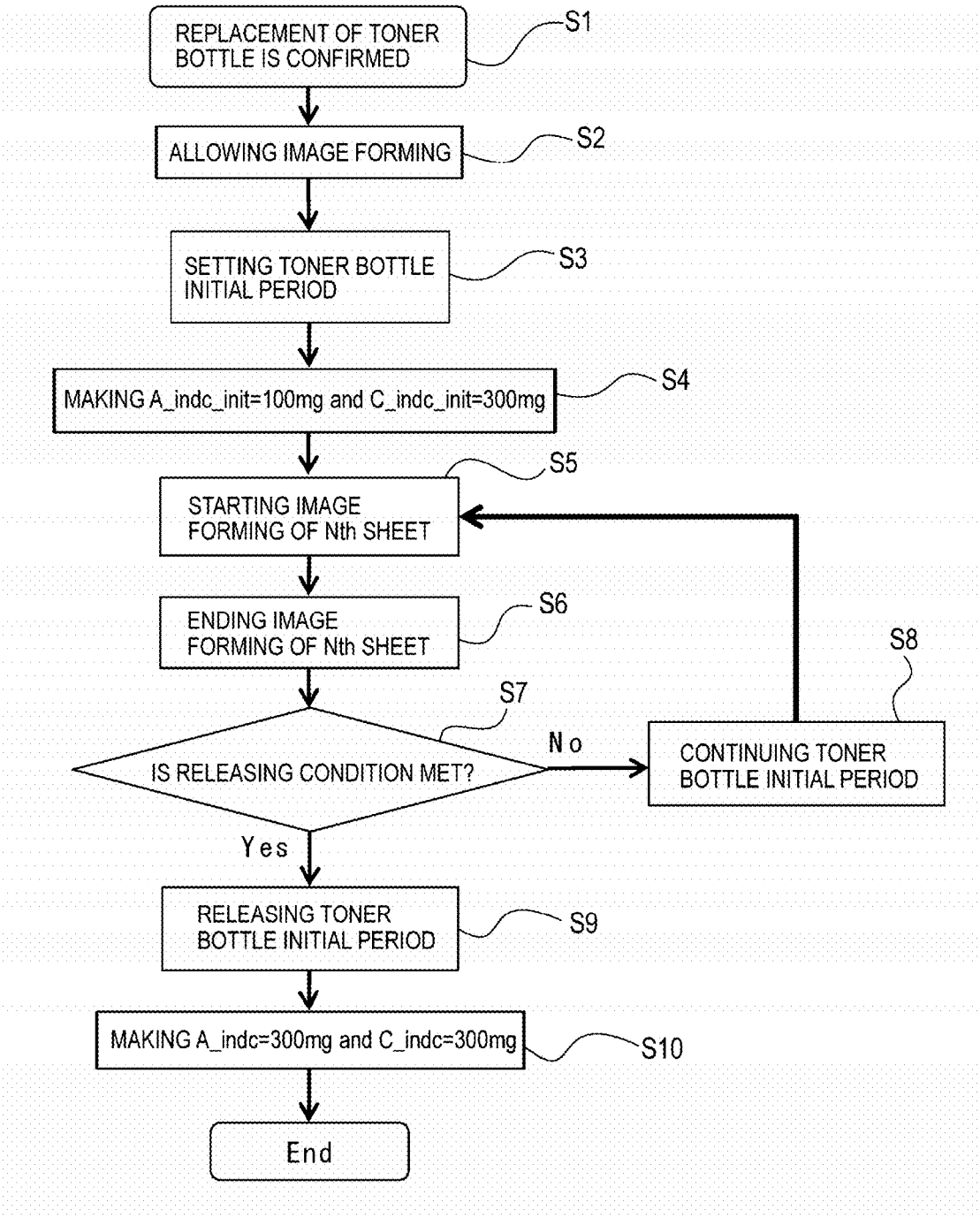
FIG. 10 is a flowchart showing a toner supply control in the second embodiment.

FIG. 10 is a flowchart showing the toner supply control in the present embodiment. As shown in FIG. 10, in this embodiment, the operations of the selection of the coefficients to be used according to the magnitude relation of TD_target and TD_Indc(N−1) are added to S4, S10 of the flowchart of FIG. 8. Other steps are the same as the first embodiment.

Third Embodiment

Next, the third embodiment of an image forming apparatus according to the present invention will be explained. The same reference numerals are used for the portions in which the same explanation is made as the first embodiment or the second embodiment and redundant explanations are omitted.

Instead of or in addition to changing the coefficients of the first and second embodiments, this embodiment has the following configuration. That is, an upper limit (maximum value) of inductance supply amount M_Indc of the first and second embodiments is set. Thereby, even if the difference value between TD_target and TD_Indc(N−1) is large, inductor supply amount M_Indc does not become too large. Therefore, according to the present embodiment, transition of the TD ratio after replacement of the toner bottle becomes gentle and the level of density fluctuation can be suppressed like the first and second embodiments.

In the toner bottle initial period of the present embodiment, the upper limit of the inductance supply amount M_Indc is set to 100 mg but it may be set to other value in accordance with transition of the TD ratio. In addition, for the normal period other than the toner bottle initial period, there is a little necessity for providing a limit on the inductance supply amount M_Indc but when such a limit is provided, the upper limit of the suppressing mode is made to be smaller than the upper limit of the normal mode. Thereby, accidental over-supply can be suppressed.

Fourth Embodiment

Next, the fourth embodiment of an image forming apparatus according to the present invention will be explained. The same reference numerals are used for the portions in which the same explanation is made as the first embodiment and redundant explanations are omitted.

In this embodiment, the TD_target is changed to a value less than the normal value only in the toner bottle initial period after replacement of the toner bottle in addition to the configuration of the first and the second embodiments. Specifically, the TD_target is changed from 8.0% to 7.7% only in the toner bottle initial period after replacement of the toner bottle. Then after the end of the toner bottle initial period, the TD_target is returned from 7.7% to 8.0%. Thereby, for example, when TD_target before the replacement of the toner bottle is 8.0% and absence of toner is determined with the TD_Indc=6.9%, the difference value between TD_target and TD_Indc can be changed from 1.1% to 0.8%. Therefore, the difference value between TD_target and TD_Indc(N−1) can be decreased and the inductance supply amount M_Indc can be reduced accordingly. Therefore, according to the present embodiment, transition of the TD ratio after replacement of the toner bottle becomes gentle and the level of density fluctuation can be reduced like the first, second and third embodiments.

According to the present invention, transition of the TD ratio after replacement of the toner bottle becomes gentle, the significant excess of the TD ratio from the target value can be suppressed and the level of density fluctuation can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-221819, filed Oct. 25, 2013, which is hereby incorporated by reference herein in its entirety.

What is claimed is:

1. An image forming apparatus, comprising:

a developing device configured to develop an electrostatic latent image formed on an image bearing member using toner and magnetic carrier;

a toner supplying device configured to supply toner from a toner bottle storing toner for supply;

a toner density detecting unit configured to detect information about a toner density inside of the developing device;

a control unit configured to execute a normal mode which determines a toner supply amount of the toner supplying device on the basis of a difference value between on a detection result of the toner density detecting unit and a predetermined target value, wherein the controller executes the normal mode so that (i) when the difference value is a first difference value, the toner supply amount is a first toner supply amount, and (ii) when the difference value is a second difference value which is greater than the first difference value, the toner supply amount is a second toner supply amount which is greater than the first toner supply amount;

a remaining amount detecting unit configured to detect information relating to a remaining amount of the toner bottle; and a replacement detecting unit configured to detect information for determining whether the toner bottle is to be replaced, wherein the control unit prohibits an image forming operation based on a detection result of the remaining amount detecting unit, thereafter the control unit immediately allows the image forming operation based on a detection result of the replacement detecting unit, and the control unit executes a supply restriction mode which determines a toner supply amount of the toner supplying device on the basis of the difference value, and wherein the control unit executes the supply restriction mode so that (i) when the difference value is the first difference value, the toner supply amount is a third toner supply amount which is less than the first toner supply amount, and (ii) when the difference value is the second difference value, the toner supply amount is a fourth toner supply amount which is less than the second toner supply amount.

2. The image forming apparatus according to claim 1, wherein the toner supply amount of the toner supply device is calculated by multiplying the difference value by a coefficient, and wherein the coefficient in the supply restriction mode is less than the coefficient in the normal mode.

3. The image forming apparatus according to claim 2, wherein in the supply restriction mode, when the detection result of the toner density detecting unit is less than a predetermined threshold value, the coefficient is set to a first coefficient and when the detection result of the toner density detecting unit is greater than the predetermined threshold value, the coefficient is set to a second coefficient which is less than the first coefficient.

4. The image forming apparatus according to claim 2, wherein the control unit changes the supply restriction mode to the normal mode when the difference value becomes within a predetermined range after replacement of the toner bottle is detected.

5. The image forming apparatus according to claim 1, wherein the control unit controls the toner supply amount such that the toner supply amount is less than or equal to a predetermined upper limit value, and wherein the predetermined upper limit value is set to a first upper limit value in the normal mode and the predetermined upper limit value is set to a second upper limit value which is lower than the first upper limit value in the supply restriction mode.

6. The image forming apparatus according to claim 1, wherein the control unit changes the supply restriction mode to the normal mode when a predetermined amount of toner is supplied from the toner supply device after the replacement of a toner bottle is detected.

7. The image forming apparatus according to claim 1, wherein the control unit performs a toner density recovery sequence which recovers a toner density of two-component developer stored in the developing device when the difference value is greater than a predetermined value after a predetermined period from a time when the toner bottle is replaced, and wherein the control unit changes the supply restriction mode to the normal mode when the toner density recovery sequence is performed after replacement of the toner bottle is detected.

* * * * *